US012550966B2

(12) United States Patent
Taylor et al.

(10) Patent No.: US 12,550,966 B2
(45) Date of Patent: Feb. 17, 2026

(54) SHOE

(71) Applicant: adidas AG, Herzogenaurach (DE)

(72) Inventors: Alexander Taylor, London (GB); Philippe-Albert Lefebvre, London (GB); Jules Mas, Paris (FR)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/293,746

(22) PCT Filed: Jul. 28, 2022

(86) PCT No.: PCT/GB2022/051998
§ 371 (c)(1),
(2) Date: Jan. 30, 2024

(87) PCT Pub. No.: WO2023/007175
PCT Pub. Date: Feb. 2, 2023

(65) Prior Publication Data

US 2024/0324712 A1 Oct. 3, 2024

(30) Foreign Application Priority Data

Jul. 30, 2021 (GB) ..... 2111051

(51) Int. Cl.
*A43B 3/24* (2006.01)
*A43B 3/00* (2022.01)
*A43B 13/36* (2006.01)

(52) U.S. Cl.
CPC ..... *A43B 3/0047* (2013.01); *A43B 3/24* (2013.01); *A43B 3/244* (2013.01); *A43B 13/36* (2013.01)

(58) Field of Classification Search
CPC ..... A43B 3/0047; A43B 3/24; A43B 3/244; A43B 13/36; A43C 15/14
(Continued)

(56) References Cited

U.S. PATENT DOCUMENTS 2,183,277 A * 12/1939 Heilhecker ..... A43B 13/36 36/15
3,318,025 A * 5/1967 Barriga ..... A43B 13/36 36/36 B (Continued)

FOREIGN PATENT DOCUMENTS

| | | |
|---|---|---|
| WO | 03/011068 A1 | 2/2003 |
| WO | 2016/133592 A1 | 8/2016 |
| WO | 2020/079714 A1 | 4/2020 |

OTHER PUBLICATIONS

International Search Report and Written Opinion dated Oct. 31, 2022 in PCT International Patent Application No. PCT/GB2022/051998, 14 pages.

*Primary Examiner* — Marie D Bays
(74) *Attorney, Agent, or Firm* — Sterne, Kessler, Goldstein & Fox P.L.L.C.

(57) ABSTRACT

A shoe comprising a sole comprising a female element; and an upper arrangement comprising a corresponding male element configured to be received in the female element upon insertion in an insertion direction. The male and female elements comprise complementary locking features including a first locking feature being provided on a peripheral surface of one of the male or female elements, and a second locking feature being provided on a peripheral surface of the other of the male or female elements. The first locking feature comprises a protrusion that protrudes in a direction transverse to the insertion direction, and the second locking feature comprises a locking recess. The locking protrusion is configured to engage with the locking recess as the male element is inserted into the female element, thereby locking the sole to the upper arrangement.

20 Claims, 15 Drawing Sheets

(58) Field of Classification Search
USPC ..... 36/15, 100, 101, 61
See application file for complete search history.

(56) References Cited

U.S. PATENT DOCUMENTS 3,538,628 A * 11/1970 Einstein, Jr. ..... A43B 3/0078 36/15
3,890,725 A * 6/1975 Lea ..... A43B 3/244 36/11.5
4,317,294 A * 3/1982 Goodyear ..... A43B 13/36 36/36 B
4,351,120 A * 9/1982 Dalebout ..... A43B 13/36 36/117.3
4,377,042 A * 3/1983 Bauer ..... A43B 13/36 36/15
4,420,894 A * 12/1983 Glassman ..... A43B 13/36 36/12
5,317,822 A * 6/1994 Johnson ..... A43B 13/36 36/15
5,802,738 A * 9/1998 Ferniani ..... A43B 3/103 36/11.5
6,442,870 B1 * 9/2002 Tsai ..... A43B 3/103 36/15
9,486,036 B1 * 11/2016 Douglas ..... A43B 23/0245
2002/0174569 A1 * 11/2002 Tsai ..... A43B 3/103 36/11.5
2005/0188562 A1 * 9/2005 Clarke ..... A43B 3/244 36/3 R
2006/0021260 A1 * 2/2006 Kim ..... A43B 21/39 36/130
2006/0080813 A1 * 4/2006 Pearce ..... A43B 3/244 24/662
2007/0289161 A1 * 12/2007 Gerber ..... A43B 3/0047 36/12
2009/0183392 A1 * 7/2009 Shane ..... A43B 3/244 12/114.2
2011/0192056 A1 * 8/2011 Geser ..... A43B 13/26 36/114
2014/0259779 A1 * 9/2014 Hashish ..... A43B 7/1445 12/142 R
2018/0055138 A1 * 3/2018 Osborn ..... A43B 17/14
2023/0404215 A1 * 12/2023 Cavaliere ..... A43B 3/244
2024/0041164 A1 * 2/2024 Kuntz ..... A43B 13/125

* cited by examiner

SHOE

CROSS REFERENCE TO RELATED APPLICATIONS

This application is a U.S. National Phase Application under 35 U.S.C. § 371 of PCT International Application No. PCT/GB2022/051998, filed Jul. 28, 2022 entitled "SHOE," which claims priority to, and the benefit of, United Kingdom Patent Application No. GB 2111051.5, filed Jul. 30, 2021, the disclosures of which are each incorporated herein by reference in their entireties for all purposes.

FIELD OF THE INVENTION

The invention relates to an item of footwear, specifically a shoe, and to a method of assembling such a shoe. The shoe is more specifically a modular shoe that can be disassembled and re-assembled, so that parts can be replaced, or so that components of the shoe can be separated for recycling.

INTRODUCTION

A conventional shoe generally comprises a sole structure and an upper secured to the sole structure in such a configuration that allows for a foot to be received and supported within the shoe. The sole structure forms the bottom of the shoe and makes contact with the ground, while the upper holds the shoe onto the foot. As such, the material of the sole structure is usually chosen for its frictional qualities and durability, while the material of the upper is often chosen for comfort and aesthetics.

The upper is usually permanently stitched or bonded to the sole structure to prevent separation of the two components. The means that it is impossible to swap out or replace components once the shoe has been constructed. As a result, many shoes are disposed of before all their components have reached their end of life. Furthermore, the permanent nature of conventional shoe construction does not facilitate the responsible disposal of shoes whereby the various component materials are recycled separately.

Some known approaches provide means for removably connecting an upper to a sole structure by means of a fastener or a zip. However, these approaches provide a connection which is inadequate in resisting the forces typically encountered when the shoe is worn for demanding activities such as running. One particular challenge of providing modular shoes is that of achieving component connections which are easy to separate when needed yet secure during normal use.

It is against this background that the invention has been devised.

STATEMENTS OF INVENTION

Against this background the invention resides in a shoe comprising: a sole comprising a female element; and an upper arrangement comprising a corresponding male element configured to be received in the female element upon insertion in an insertion direction. The male and female elements comprise complementary locking features including: a first locking feature being provided on a peripheral surface of one of the male or female elements and comprising a protrusion that protrudes in a direction transverse to the insertion direction, and a second locking feature being provided on a peripheral surface of the other of the male or female elements and comprising a locking recess. The locking protrusion may be configured to engage with the locking recess as the male element may be inserted into the female element, thereby locking the sole to the upper arrangement.

By virtue of the male and female elements and the complementary locking features, the sole can be locked securely to the upper arrangement for use of the shoe, but can be unlocked and removed on application of sufficient force. The arrangement therefore allows for a modular shoe construction, in which a sole and upper arrangement can be assembled, disassembled, and interchanged to similar components as needed. This allows for easy manufacture of the shoe, as well as easy repair of worn components, and easy separation for end-of-life recycling.

The upper arrangement may comprise an element-supporting surface and the male element may comprise a body extending away from the element supporting surface in the insertion direction. The body may comprise a free end opposite the element-supporting surface and an outer peripheral surface that extends between the element-supporting surface and the free end.

The locking feature on the male element may be provided on the outer peripheral surface.

The female element may comprise an opening in the sole for receiving the male element, the opening defining an inner peripheral surface.

The locking feature on the female element may be provided on the inner peripheral surface.

The locking feature on the female element may be the first locking feature and the locking feature on the male element may be the second locking feature.

The locking recess may be substantially continuous around the outer peripheral surface.

The locking recess may comprise a groove.

The locking recess may define an opening for receiving the locking protrusion into the locking recess in an engagement direction. The engagement direction may be transverse (i.e. non-parallel) to the insertion direction. For example, the engagement direction may be perpendicular to the insertion direction The locking recess and the locking protrusion may comprise first and second complementary abutment surfaces respectively, configured to abut upon relative movement of the upper arrangement in a direction opposite to the insertion direction, to resist removal of the male element from the female element.

The first abutment surface may be provided on the locking recess and may face the upper supporting surface. The second abutment surface may be provided on the locking protrusion and may face the first abutment surface when the shoe is assembled.

The locking protrusion may protrude from the peripheral surface to define a protrusion end offset from the peripheral surface. The locking protrusion may comprise a tapered end region extending between the protrusion end and the peripheral surface to meet the peripheral surface at an acute angle.

The locking protrusion may define a first locking protrusion of a set of locking protrusions, wherein the set of locking protrusions are arranged to engage with the locking recess.

The body of the male element may have a cross section orthogonal to the longitudinal axis, the cross section having a first geometric shape. The female element may have a cross section orthogonal to the insertion direction, the cross section having a second geometric shape that may be substantially similar to the first geometric shape.

The sole may comprise a base surface that faces away from the upper arrangement when the shoe is assembled. The opening may be a through hole extending through the sole to open onto the base surface The male and female elements may be configured such that the free end of the male element is substantially flush with the base surface to form a tread surface when the shoe is assembled for use.

The upper arrangement may comprise: a shoe upper having a base, and an insole comprising the element supporting surface and suitable for inserting into the shoe upper. The base may be configured to accommodate the male element to allow insertion of the male element into the female element so that the base of the shoe upper may be sandwiched between the sole and the insole when the shoe is assembled.

The base may comprise an aperture through which the male element extends when the insole is inserted into the shoe upper.

At least a part of the inner peripheral surface of female element may be proximate to the perimeter of the sole to couple the sole to the upper arrangement in the region of the perimeter when the shoe may be assembled.

The sole may comprise a plurality of female elements and the upper arrangement may comprise a corresponding male element for each female element.

The shoe may further comprise a support element removably connectable to the sole to support the upper arrangement.

The upper arrangement may comprise a side region, a heel region and a toe region, and the support element may be arrangeable to support the side region or the heel region or the toe region.

The support element and the sole comprise cooperating connection features to removably connect the support element to the sole.

The cooperating connection feature on the sole may comprise a first connection aperture. The cooperating connection feature on the support element may comprise a second connection aperture and a male connection element that connects the first and second connection apertures.

The male elements may be made from substantially the same material as the sole.

The male elements and/or the sole may be made of an elastically deformable material.

The protrusion of the first locking feature may be formed integrally on the peripheral surface of the male or female element. Alternatively, the protrusion of the first locking feature may be formed of a separate piece that is attachable to the peripheral surface of the male element or the female element.

The invention also extends to a method of assembling the modular shoe described above. The method comprises: inserting the male element into the female element in an insertion direction; engaging the first locking feature with the second locking feature as the male element may be inserted into the female element, thereby locking the sole to the upper arrangement.

BRIEF DESCRIPTION OF THE DRAWINGS

In order that the present invention may be more readily understood, embodiments of the invention will now be described, by way of non-limiting example, with reference to the following figured, in which.

DETAILED DESCRIPTION OF EMBODIMENTS OF THE INVENTION

Figure 1:
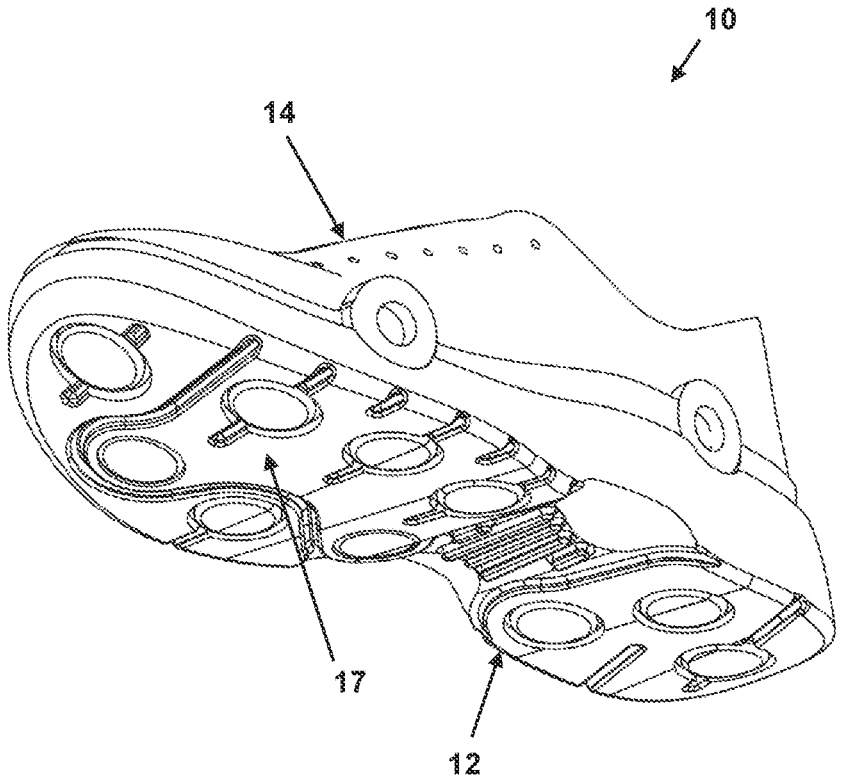
FIG. 1 is a perpendicular view of an assembled shoe according to an embodiment of the invention.

FIG. 1 shows a shoe 10, specifically a modular shoe comprising modular sections that can be assembled together to form the shoe 10, and disassembled when required, for example for end of life recycling of the different sections, or to allow for replacement of one or more sections.

Figure 2:
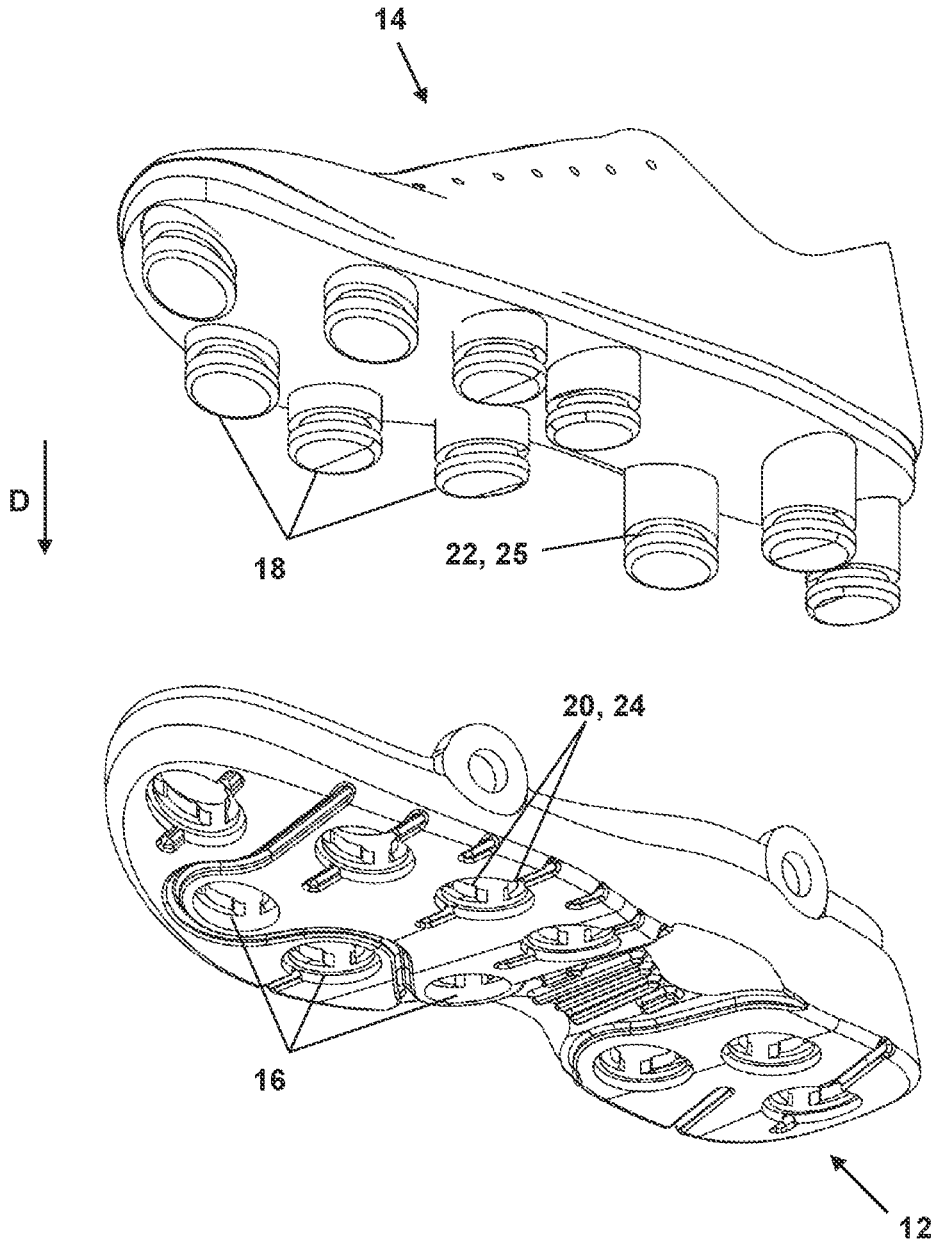
FIG. 2 is an exploded view of a shoe according to an embodiment of the invention.

The shoe 10 comprises a sole 12 and an upper arrangement 14. As best seen in FIG. 2, the sole 12 comprises a plurality of female elements 16, and the upper arrangement comprises a plurality of corresponding male elements 18. The male elements 18 are arranged to align with the female elements 16, and the female elements 16 are open to allow insertion of the male elements 18 into the female elements 16 in an insertion direction D. When the shoe 10 is oriented for use, the insertion direction is a vertically downward direction, though it will be appreciated that the insertion direction will change if the shoe is oriented differently.

The male and female elements 18, 16 comprise cooperating locking features 20, 22 that are configured to engage when the male element 18 is inserted into the female element 16. In this example, a set of locking features 20 is provided on the female element 16, each locking feature 20 comprising a locking protrusion 24, and the locking feature 22 on the male element 18 comprises a locking recess 25. Each locking protrusion 24 protrudes in a direction that is transverse (i.e. non-parallel) to the insertion direction D, and is shaped to be received in the locking recess 25.

The male and female elements 18, 16 are arranged generally around the periphery of the shoe 10. For example, the elements may be spaced no more than approximately 25 mm from the perimeter of the sole, and preferably no more than approximately 15 mm. In this case, on a lower surface of the shoe 10, a central region is substantially free from male and female elements 18, 16, to define a central element-free region 17 (see FIG. 1), though it should be appreciated that this need not be the case.

The sole 12 may be any component that is arranged between the upper and the ground when the shoe is in use. Typically, this will be a midsole, outsole, or combination of a midsole and outsole. In the embodiment shown, the sole 12 is a combined midsole and outsole.

Figure 3:
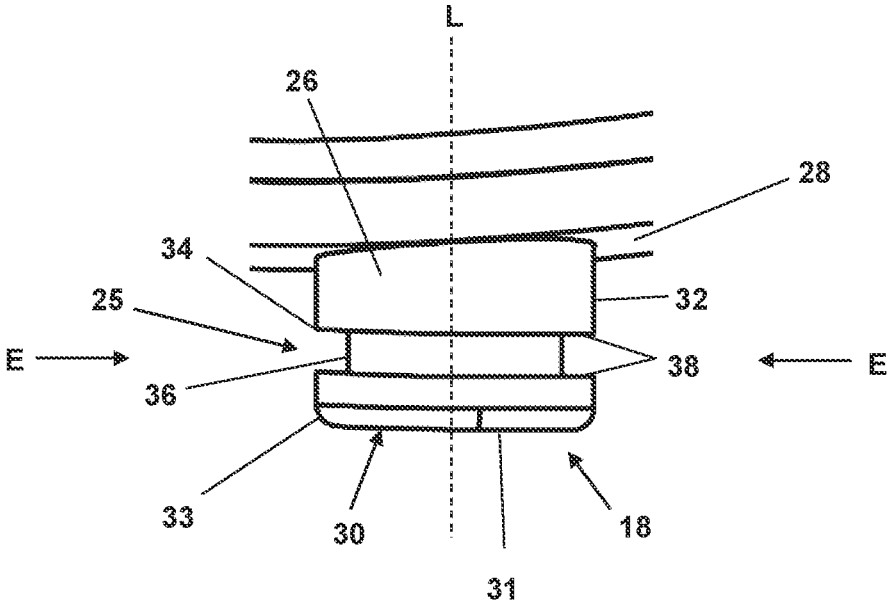
FIG. 3 is a close-up view of a male element of a shoe according to an embodiment of the invention.

FIG. 3 shows a male element 18 in isolation. The male element 18 comprises a body 26 that is supported on, and extends away from, an element supporting surface 28 forming part of the upper arrangement 14. In this way, the body 26 defines a longitudinal axis L that is parallel to the insertion direction D. A root of the male element joins the male element to the element supporting surface 28. A free end 30 is arranged opposite to the root, and an outer peripheral surface 32 joins the root to the free end 30. In this embodiment, the body 26 is substantially cylindrical, and hence has a circular cross section orthogonal to the longitudinal axis, though the body 26 may be of other suitable shapes, and may for example have a cross section of another geometric shape. The body need not extend orthogonal to the base but may instead extend at a non-orthogonal angle.

At the free end 30, the male element 12 defines an end surface 31. Around the periphery of the end surface 31, an edge 33 that joins the end surface 31 to the outer peripheral surface 32 is optionally radiused, to define a taper or ramp transitioning from the vertical outer peripheral surface 32 to the horizontal end surface 31. In other embodiments the edge may be chamfered with a liner taper.

The locking recess 25 is formed on the outer peripheral surface 32 of the element 18, and is spaced a short distance from the free end 30 of the body 26—for example between approximately 2 mm and approximately 10 mm, and preferably approximately 5 mm. The locking recess 25 takes the form of a groove that extends continuously around the perimeter of the body 26. The groove defines an opening 34 that permits insertion of the locking protrusion 24 into the groove in a radial engagement direction E that is transverse (i.e. non-parallel) to the insertion direction D, and in this case is perpendicular to the insertion direction D.

A base surface 36 is arranged opposite to the opening 34, and side surfaces 38 extend between the base surface 36 and the opening 34. In this example, the base surface 36 and side surfaces 38 are orthogonal, such that the groove has a generally square or rectangular cross-section, though other arrangements are possible.

As is best seen in FIG. 2, the male elements 18 are of different lengths across the shoe 10. The lengths of the male elements 18 match the corresponding depth of the sole 12 in the region of the respective female element 16. In this way, in this embodiment, each male element 18 extends through the entire depth of the sole 12 when the shoe is assembled. It should be noted that in other embodiments the male elements need not extend through the entire depth of the sole.

Figure 4A:
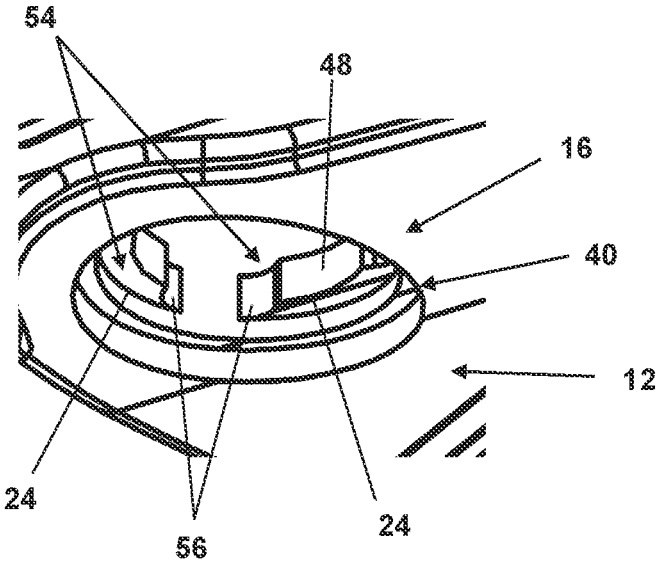
FIG. 4*a* is a close-up view of a female element of a shoe according to an embodiment of the invention.
Figure 4B:
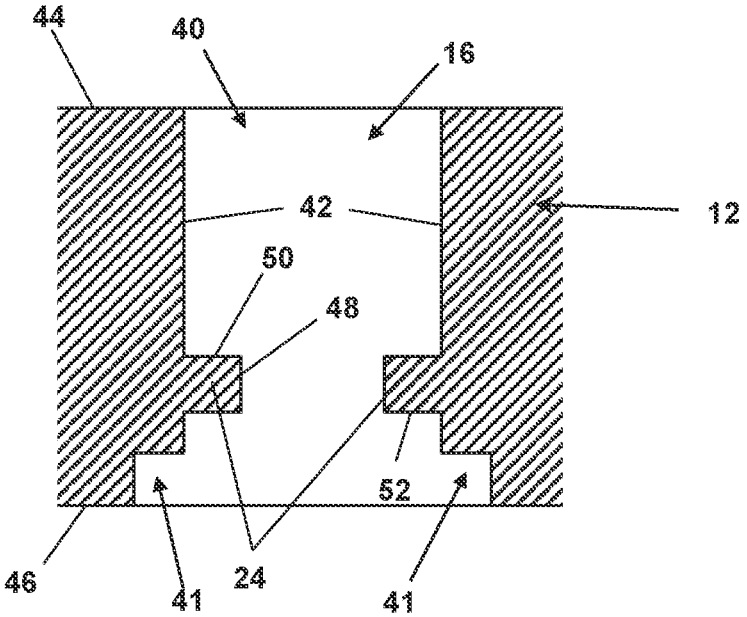
FIG. 4*b* is a cross sectional view of a female element of a shoe according to an embodiment of the invention.

FIGS. 4*a* and 4*b* show a female element 16 in isolation. The female element 16 comprises an opening 40 in the sole 12, which defines an inner peripheral surface 42. In this example, the opening 40 is a through-hole, such that it is open to both an upper-facing surface 44 and a base surface 46 of the sole 12. The opening 40 is of substantially the same size and shape as the cross section of the body 26 of the male element 18, so that in this example the opening 40 is circular, and the inner peripheral surface 42 is a substantially cylindrical surface.

The locking protrusions 24 are formed on the inner peripheral surface 42 of the female element 16, and are spaced a short vertical distance upwardly from the base surface 46—for example between approximately 2 mm and approximately 10 mm, and preferably approximately 5 mm. This distance corresponds to a respective spacing between the free end 30 and the locking recess 25 of the male element 18.

The locking protrusions 24 define a set of locking protrusions that protrude radially inwardly from the inner peripheral surface 42. In this example, the set comprises three locking protrusions 24, but the set may comprise any suitable number of locking protrusions 24, including for example only one locking protrusion.

Each locking protrusion 24 joins the inner peripheral surface 42 at a base of the locking protrusion, and extends radially inwardly towards a protrusion end 48. Upper and lower surfaces 50, 52 lie substantially orthogonal to the insertion direction, facing towards the upper-facing surface 44 and base surface 46 respectively. Each protrusion 24 comprises lateral end regions 54 that encompass lateral end surfaces 56. The lateral end regions 54 are tapered, so that the lateral end surfaces 56 meet the inner peripheral surface 42 at an acute angle. In this example, the lateral end surfaces 56 are concave curved surfaces. These tapered lateral end regions 54 reduce stress concentration where the locking protrusions 24 meet the inner peripheral surface 42, thereby improving wear resistance of the locking protrusions.

In this example, the locking protrusions 24 together define a circumferential ledge that protrudes inwardly from the inner peripheral surface 42. The ledge is broken or interrupted to define the separate locking protrusion in the set, such that the locking protrusions 24 are spaced apart by a spacing 25, with the lateral end regions 54 adjacent to the spacings 25.

As can be best seen in FIG. 4*b* and also in FIG. 2, the locking protrusions 24 are evenly spaced within the set, so that the spacing 54 is the same between each neighbouring pair of locking protrusions 24. In this example, a length of each locking protrusion 24 extending around the circumference of the inner peripheral surface 42, including the lateral end regions 54, is greater than a spacing between adjacent locking protrusions 24.

It should be appreciated that the locking protrusions may be of any suitable number, shape or arrangement.

Referring again to FIG. 4*b*, the opening 40 is of substantially the same width throughout its length except in the region of the locking protrusion 24 and in an enlarged base region 41 that opens on to the base surface 46 of the sole 12. In the base region 41, the opening is of slightly large diameter that in the remainder of the opening 40. When the male element 18 is arranged in the opening 40, the enlarged base region 41 provides a small clearance around the free end 30 of the male element 18, which can be seen most clearly in FIG. 6*d*.

Figure 5:
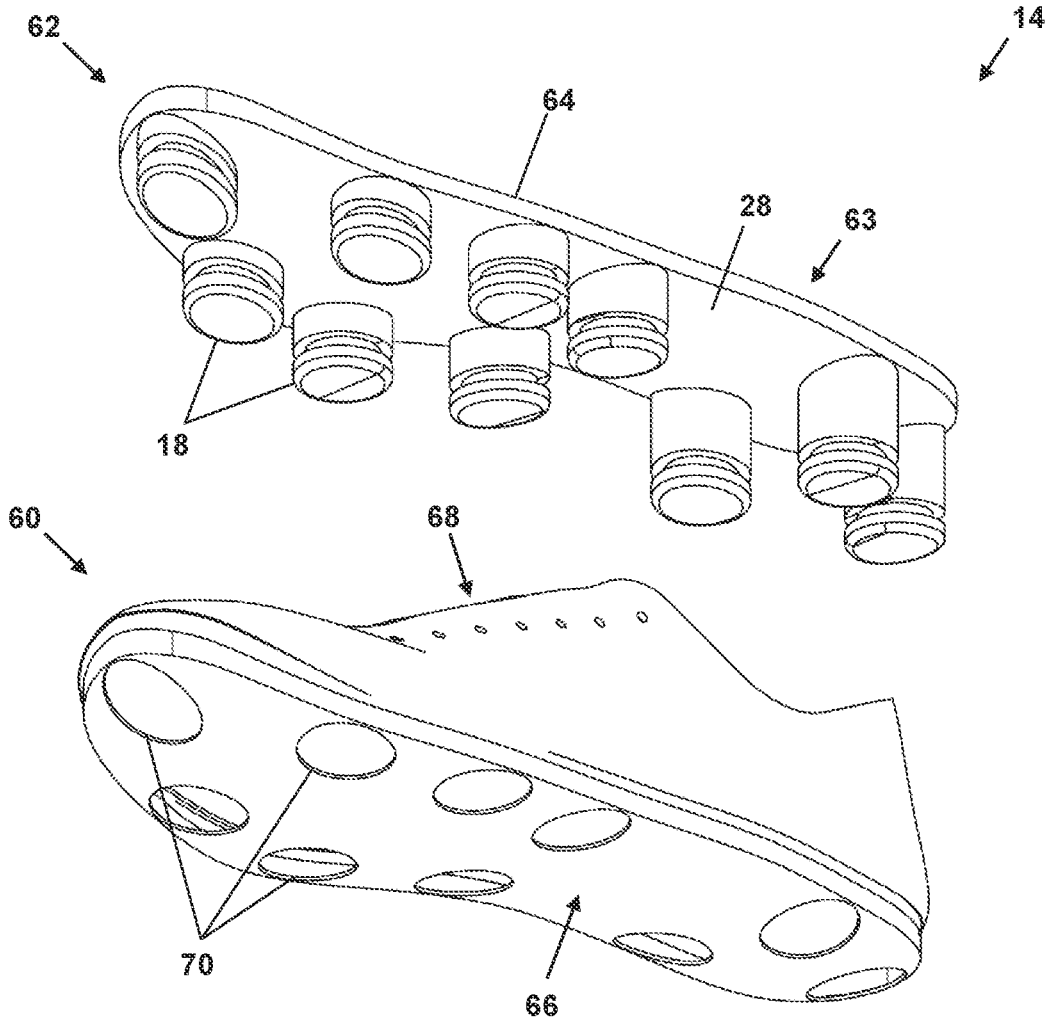
FIG. 5 is an exploded view of an upper arrangement of a shoe according to an embodiment of the invention.

FIG. 5 shows the upper arrangement 14 in more detail and reveals that the upper arrangement 14 comprises an upper 60 and an insole 62 that is insertable into the upper 60.

The insole 62 comprises a generally flat substrate 63 and comprises an upper surface that defines a foot-supporting surface 64 and a lower surface that defines an element supporting surface 28. The male elements 18 depend downwardly from the element-supporting surface 28. In this example the substrate 63 and male elements 18 are formed integrally from the same body, and are formed of the same material. Suitable materials are for example suitable plastics materials, rubber materials or foams, such as algae foam or a flexible polyurethane. Preferably the material is an elastically deformable material.

In this example, the upper 60 is of sock-like construction and comprises a base 66 and a shaft 68. In use the base 66 is sandwiched between the substrate 63 of the insole 62 and the sole 12, and the shaft 68 encloses the wearer's foot. The upper may be made of any suitable material, such as a knitted or woven material, another fabric material, a rubber or other polymer, a leather material. The base 66 and shaft 68 may be made of the same material, or of different materials.

The base 66 defines a base plane that in use is arranged below the insole 62. The base 66 is configured so that when the insole 62 is inserted into the upper 60, with the substrate 63 resting on top of the base 66, the male elements 18 can project downwardly below the base plane, for engagement with the female elements 16 of the sole 12.

In this example, the base 66 comprises apertures 70 that are arranged to align with the male elements 18, such that the male elements 18 protrude through the apertures 70 when the insole 62 is arranged in the upper 60. In other examples, the upper 60 may be made of a flexible material, such that the base surface 66 can deform around the male elements 18.

Figure 6A:
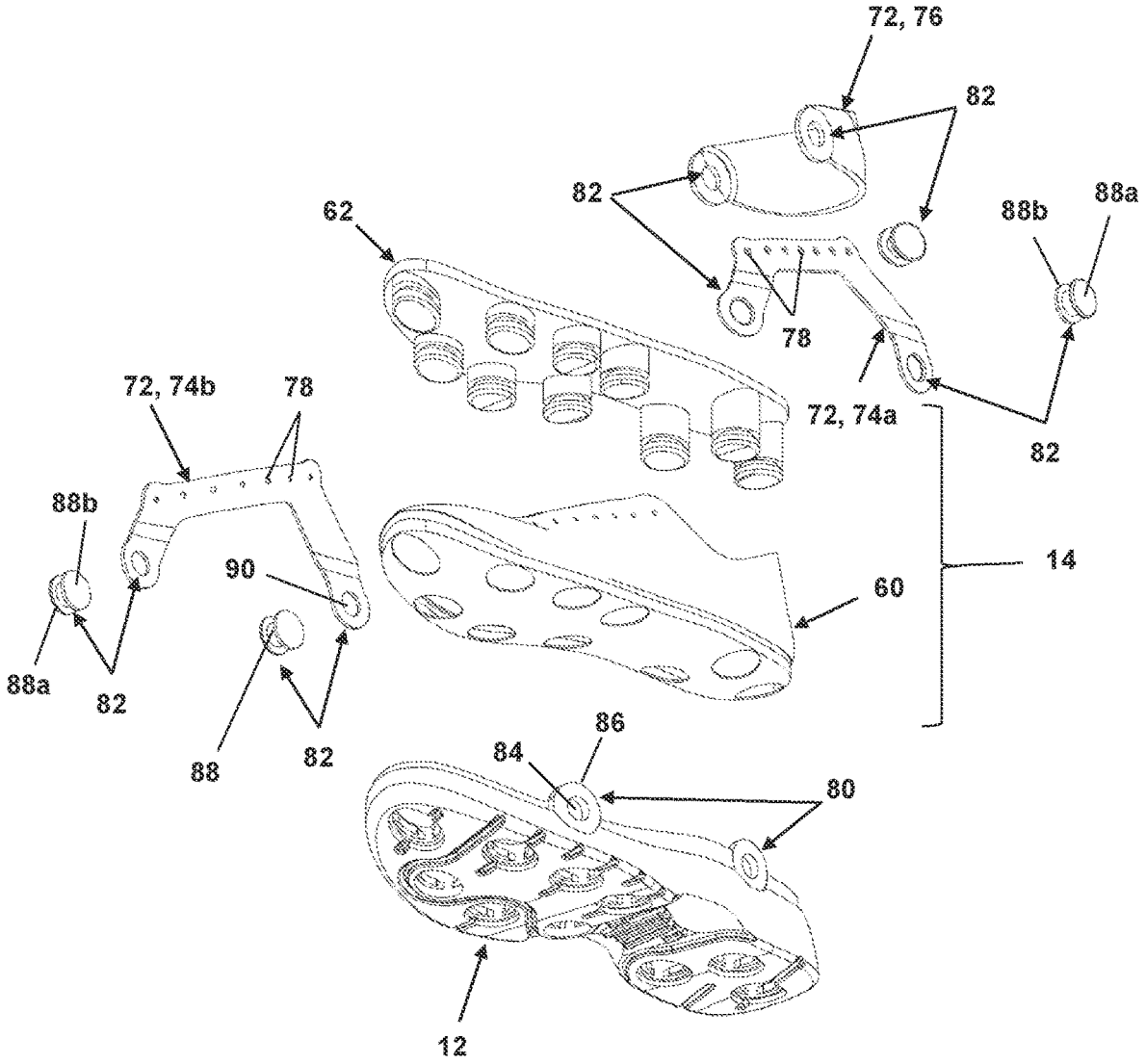
FIGS. 6*a* to 6*c* are exploded and partially exploded views of a shoe according to an embodiment of the invention.

FIG. 6*a* shows the upper arrangement 14 and sole 12 described above with additional optional support elements 72 in the form of left and right side support elements 74*a*, 74*b* and a rear heel support element 76. The side support elements 74*a*, 74*b* are configured to conform to the contours of side regions of the upper 60. In this embodiment the side support elements are generally 'U' shaped, but it will be appreciated that the side support elements may be of any suitable shape. The side support elements 74*a*, 74*b* may comprises eyelets 78 to accommodate laces and reinforce corresponding eyelets in the upper 60. The heel support element 76 is configured to conform to the heel region of the upper 60, and in particular is configured to wrap around the rear of a user's heel.

The support elements 72 are configured to provide additional support to the user's foot, and are preferably made of a material that is stiffer than the material of the upper 60. Any suitable material may be used, such as for example a plastic material, and may be made by any suitable method such as moulding, 3D printing, or forming from a cut or stamped sheet of material.

The support elements 72 are configured for removable connection to the sole 12. To this end, the support element 72 and sole 12 comprise complementary connection features 80, 82. In this example, the complementary connection features 80 on the sole 12 are female connection features, and the complementary connection features 82 on the support elements 72 are male connection features.

The sole 12 comprises front and rear female connection features 80 on each of the left and right sides of the sole 12. Each female connection feature 80 on the sole 12 comprises an opening 84 and a surround 86 that surrounds the opening 84. The surround 86 is arranged to protrude vertically upward when the shoe 10 is arranged for use, above the upper surface of the sole 12. The surround 86 is also arranged to sit outboard of the upper surface of the sole 12. In this way, as seen in FIG. 1, in the assembled shoe 10 the surround 86 and hence the opening 84 sits above the upper surface of the sole 12, and outboard of the upper arrangement 14, where it is easily accessible for connection to the support elements 72.

In the embodiment shown, each male connection feature 82 on each support element 72 is configured to be removable from the support element 72. In this way, the male connection feature 82 comprises a removable male connection element 88 in the form of a double-ended stud, and an opening 90 in the connection feature 72. A first end 88*a* of the stud 88 can be inserted into the opening 90 in a push fit to assemble the male connection feature 82 on the support element 82, and a second end 88*b* of the stud 88 can be inserted into the opening 84 of the female connection feature 80 on the sole 12, thereby connecting the support element 82 to the sole 12.

Each side support element 74*a*, 74*b* is configured for connection to respective front and rear connection features 80 via a respective stud 88. In other words, the left side support element 74*a* is configured to connect to the front left and rear left connection features 80, and the right side support element 74*b* is configured to connect to the front right and rear right connection features 80 (not visible in FIG. 6*a*).

At the rear of the shoe, the heel support element 76 is configured for connection to the left and right rear connection features 80 of the sole 12. In this way, at the rear of the shoe, the left side support element 74*a* connects to the same female connection feature 80 as the left side of the heel support element 76, and the right side support element 74*b* connects to the same female connection feature 80 as the right side of the heel support element 76. A single stud 88 acts as the removable male connection element of both the rear male connection feature 84 of the side support element 74 and the heel support element 76.

The connection features 80, 82 thereby securely connect the support elements 72 to the sole, so that, in use, the support elements 72 lie outboard of the upper arrangement 14, to support a user's foot.

It should be appreciated that in other embodiments, the studs 88 may be integral with the support elements 72 to define the male connection features 82. In this case, the studs may be single-ended studs.

The stages of assembly of the shoe will now be described with reference to FIGS. 6*a* to 6*f*.

The sole 12, upper 60 and insole 62, and support elements 72 are provided as shown in FIG. 6*a*.

Figure 6B:
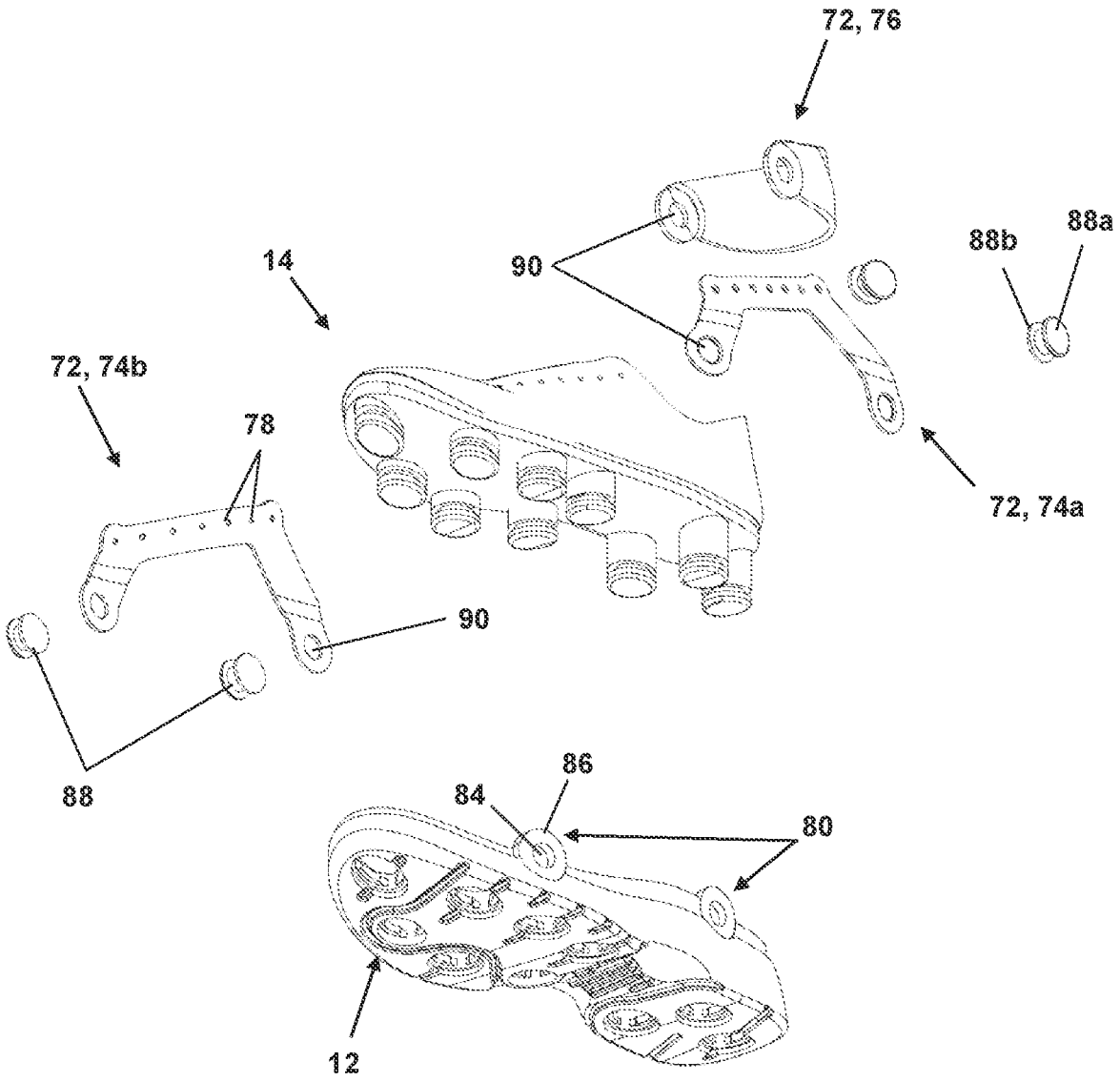

First, the insole 62 is inserted into the upper 60 in the configuration shown in FIG. 6*b* to form the upper arrangement 14. The male elements 18 are aligned with the apertures 70 in the base 66 of the upper 60, and the insole 62 is pushed into position, such that a base surface 28 of the substrate 63 of the insole 62 lies against the base 66 of the upper 60, and such that the male elements 18 protrude through the apertures 70.

Figure 6C:
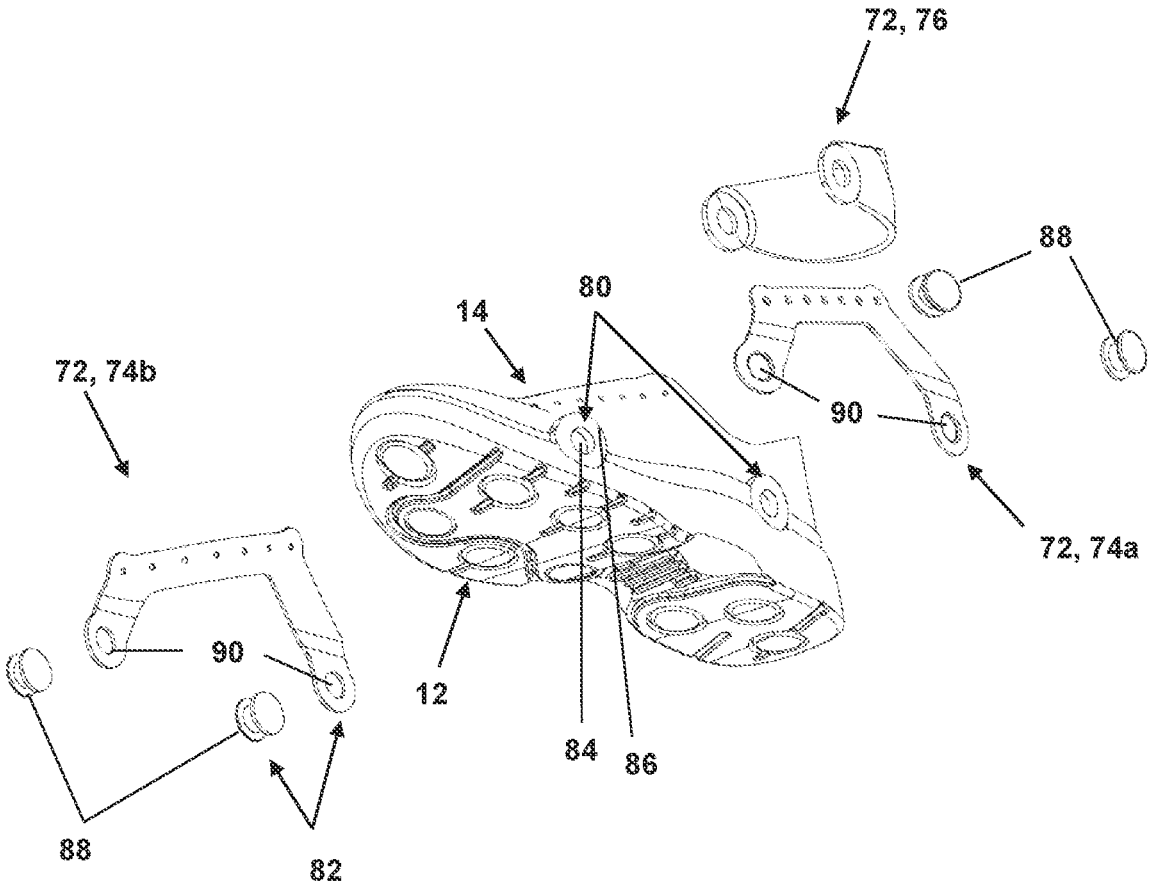
Figure 6D:
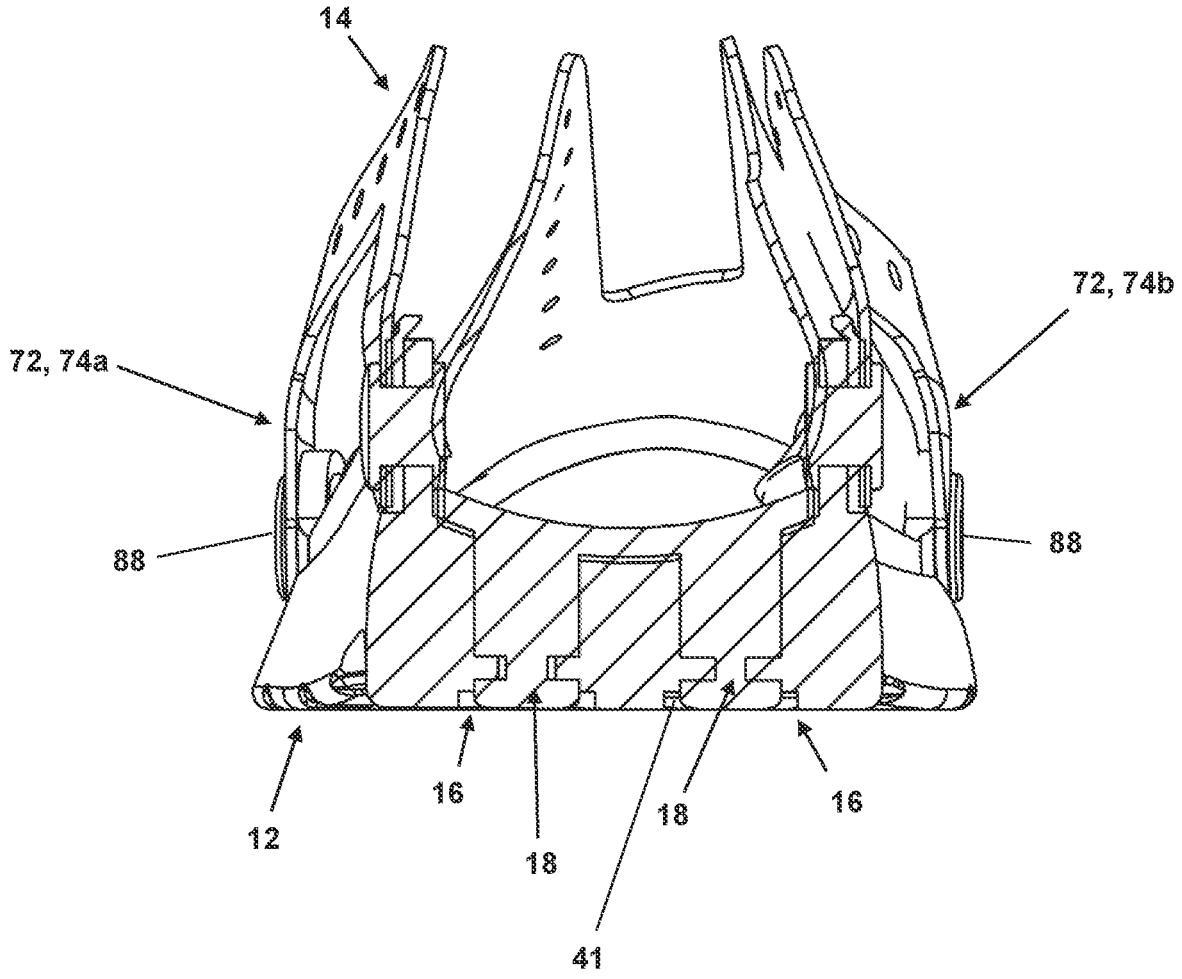
FIG. 6*d* is a cross-sectional rear view of a shoe according to an embodiment of the invention.

The upper arrangement 14 is then fitted to the sole 12 as shown in FIGS. 6*c* and 6*d*. The male elements 18 of the upper arrangement 14 are aligned with, and then inserted into, the female elements 18 of the sole 12 in the insertion direction D. Insertion continues until the free end 30 of the male element 18, and in particular the radiused edge 33, comes into contact with the locking protrusion 24 of the female element, and in particular comes into contact with the upper surface 50 of the locking protrusion 24.

At this point pressure is applied in the region of the male element 18 to push the radiused edge over the locking protrusion 24, until the locking recess 25 aligns with the locking protrusion 24. As the locking recess 25 and locking protrusion 24 come into alignment, the locking protrusion 24 moves in a snap fit into the locking recess 25 in an engagement direction that is orthogonal to the insertion direction D, thereby locking the male element 18 within the female element 16.

With all the locking features 20, 22 successfully engaged, the base 66 of the upper 60 is sandwiched between the upper-facing surface 44 of the sole 12 and the lower surface 28 of the insole 62. Because a height of each male element 18 in the insertion direction matches a corresponding height of each female element 16, the end surfaces 31 of each of the male elements 18 lie in the same plane as a base surface 46 of the sole 12. In this way, in this embodiment, the end surfaces 31 and the base surface 46 together define a lower tread surface of the shoe 10 that contacts the ground during use. In other embodiments where the male element does not extend all the way through the sole 12, the lower tread surface fo the shoe may be defined only by a base surface of the sole.

Figure 6E:
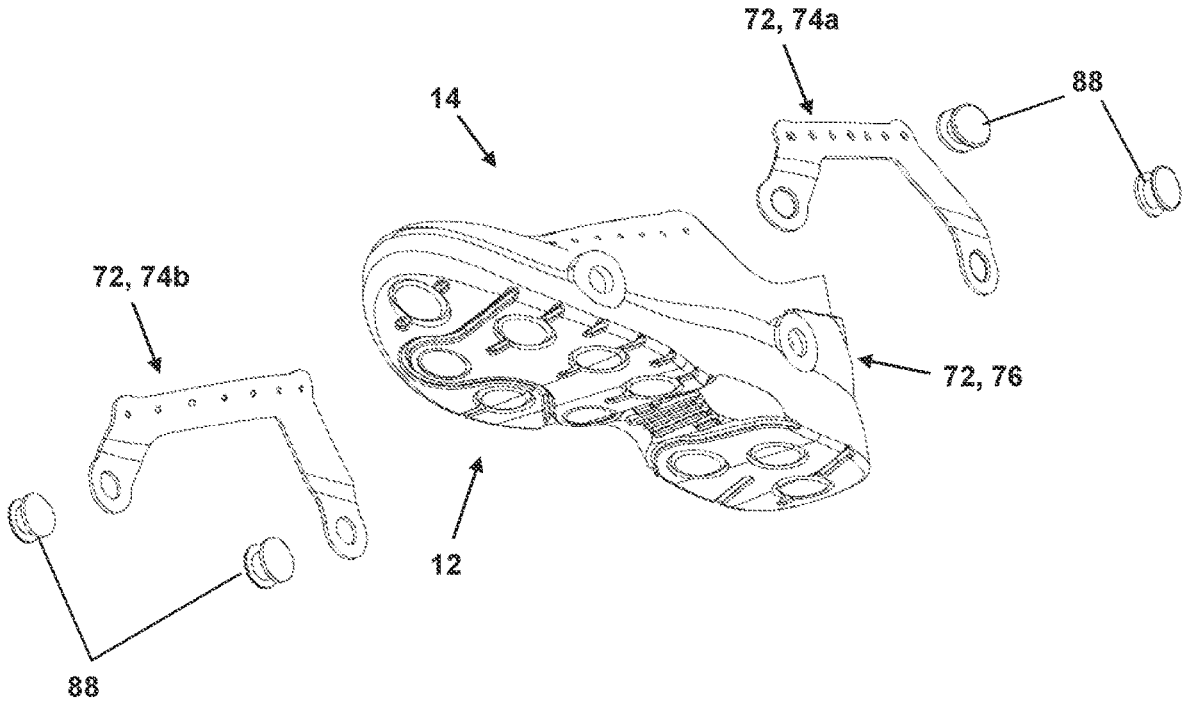
FIGS. 6*e* and 6*f* are partially exploded views of a shoe according to an embodiment of the invention.
Figure 6F:
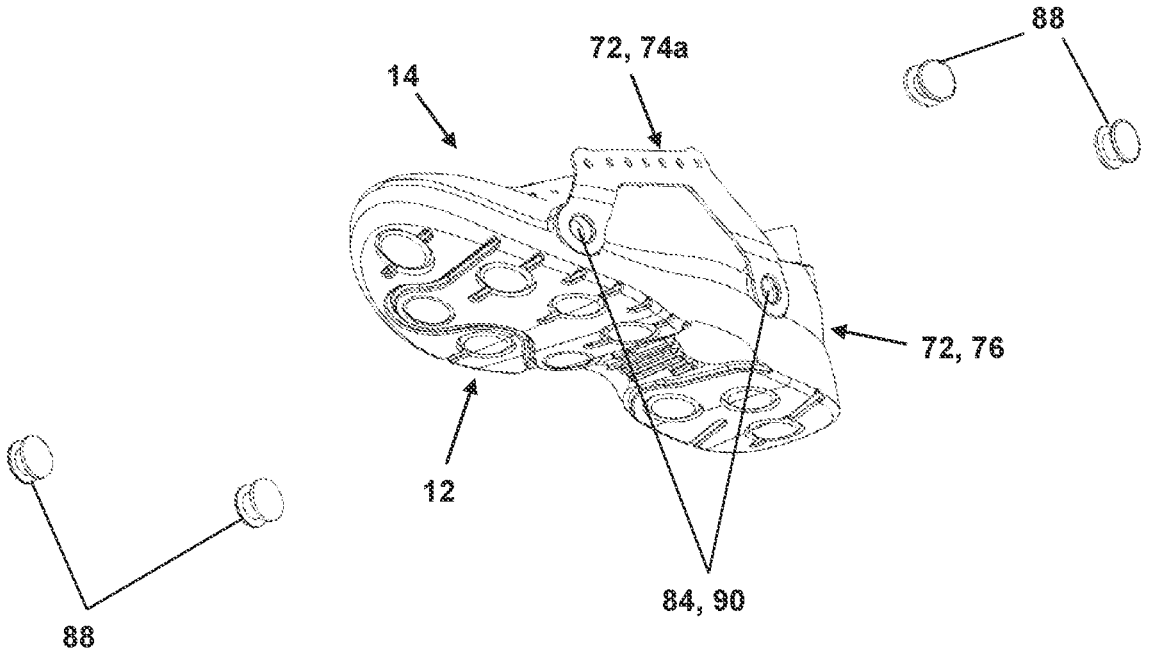

Finally, as shown in FIGS. 6*e* and 6*f*, the support elements 72 are connected to the sole 12. The support elements 72 are arranged in place outboard of the upper, with the connection openings on the support elements 72 adjacent to the connection openings on the sole 12, as shown in FIG. 6*e*. The studs 88 are then pushed into place to connect the connection openings together, thereby securing the support elements 72 in place.

In this state, the shoe 10 is fully assembled for use.

In its assembled state, the locking features 20, 22 hold the sole 12 and upper arrangement 14 together particularly securely, so that as the shoe 10 is worn, the components remain engaged, with no risk of separation. In particular, if use of the shoe 10 causes forces that tend to move the upper arrangement 14 upwardly with respect to the sole 12, referring to FIG. 6*d*, the lower surface 52 of the locking protrusion 24 abuts against the lower horizontal surface 38 of the locking recess 25 to prevent that movement. In this way, the lower surface 52 of the locking protrusion 24 and the lower horizontal surface 38 of the locking recess 25 define corresponding abutment surfaces that about to prevent the male element 18 being pulled out of the female element 16 in a direction opposite to the insertion direction during normal use.

During use of the shoe 10, forces that would tend to separate the sole 12 from the upper arrangement 14 are most likely to be applied at the periphery of the sole 12. The position of the male and female elements 18, 16 close to the periphery of the shoe 10 provides particularly good engagement at the periphery, sole where it is needed most. This contributes to providing a particularly secure engagement.

To disassemble the shoe 10, for example for replacement of a component, or for end-of-life recycling of the shoe 10, the upper arrangement 14 can be separated from the sole 12 by applying appropriate forces. This may be done by hand, by using an appropriate tool, or by a machine.

By virtue of the elastically deformable material of the male element 16, and the clearance region around the radiused edge 33 of the end region 30 of the male element 18, the male element 18 can be deflected to one side of the opening 40 of the female element 16, so that the locking protrusion 24 is withdrawn from the locking recess 25 at one side of the male and female elements 18, 16, in a direction opposite to the engagement direction.

The male element 16 can then be further deflected so that a region of the radiused edge 33 passes up into the opening 40 and over the locking protrusion 24. The spacings 25 between the locking protrusions also allow for some deformation of the locking protrusions 24, and create some free space to facilitate passage of the end region 31 of the male element 16. With the locking features 20, 22 thereby disengaged, the male element 18 can be removed from the female element 16 in a direction opposite to the insertion direction.

If the upper assembly requires disassembly, the insole 62 can simply be removed from the upper 60 by withdrawing the substrate 63, and hence withdrawing the male elements 18 from the apertures 70.

With the components separated, the shoe can be recycled as appropriate. Alternatively, one or more components can be replaced, and the shoe can be reassembled for re-use.

The modular shoe arrangement described therefore provides a shoe that can be easily disassembled and re-assembled when required, but that is secure during use of the shoe, particularly by virtue of the combination of the male and female elements, and the co-operating locking features.

Figure 7:
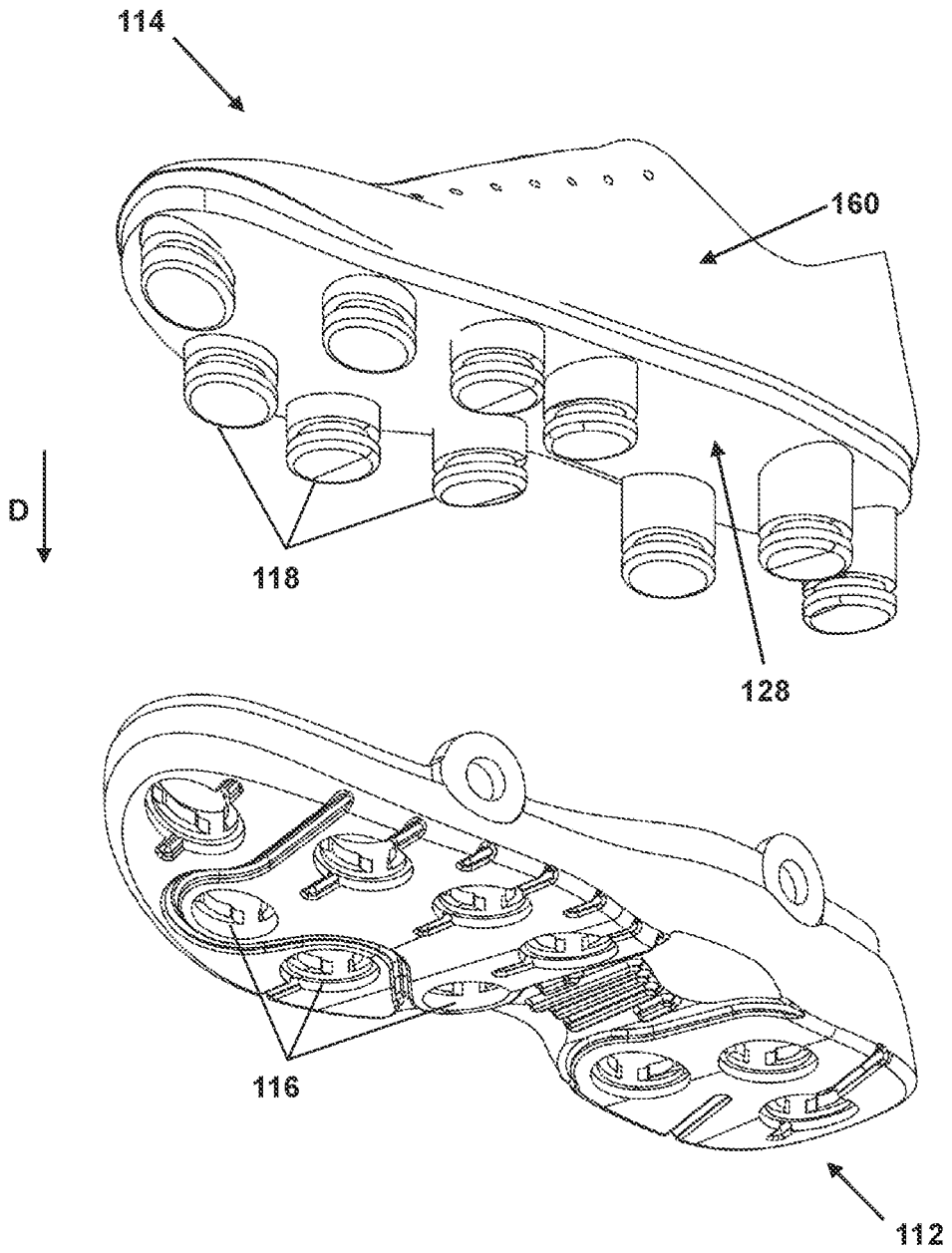
FIGS. 7 to 10 are exploded views of a shoe according to embodiments of the invention.

FIG. 7 illustrates an alternative modular shoe arrangement. The sole 112 is substantially the same as the sole of FIG. 2. However, the upper arrangement 114 differs in that the male elements 118 are provided as integral components with the shoe upper 160. In this way, the element supporting surface 128 is defined by a base of the upper 160, such that the male elements 118 protrude from the base. In this embodiment, there may be no separate insole, or the insole may be provided as a conventional insole (not shown) that is arrangeable inside the upper 160 in a conventional manner.

Figure 8:
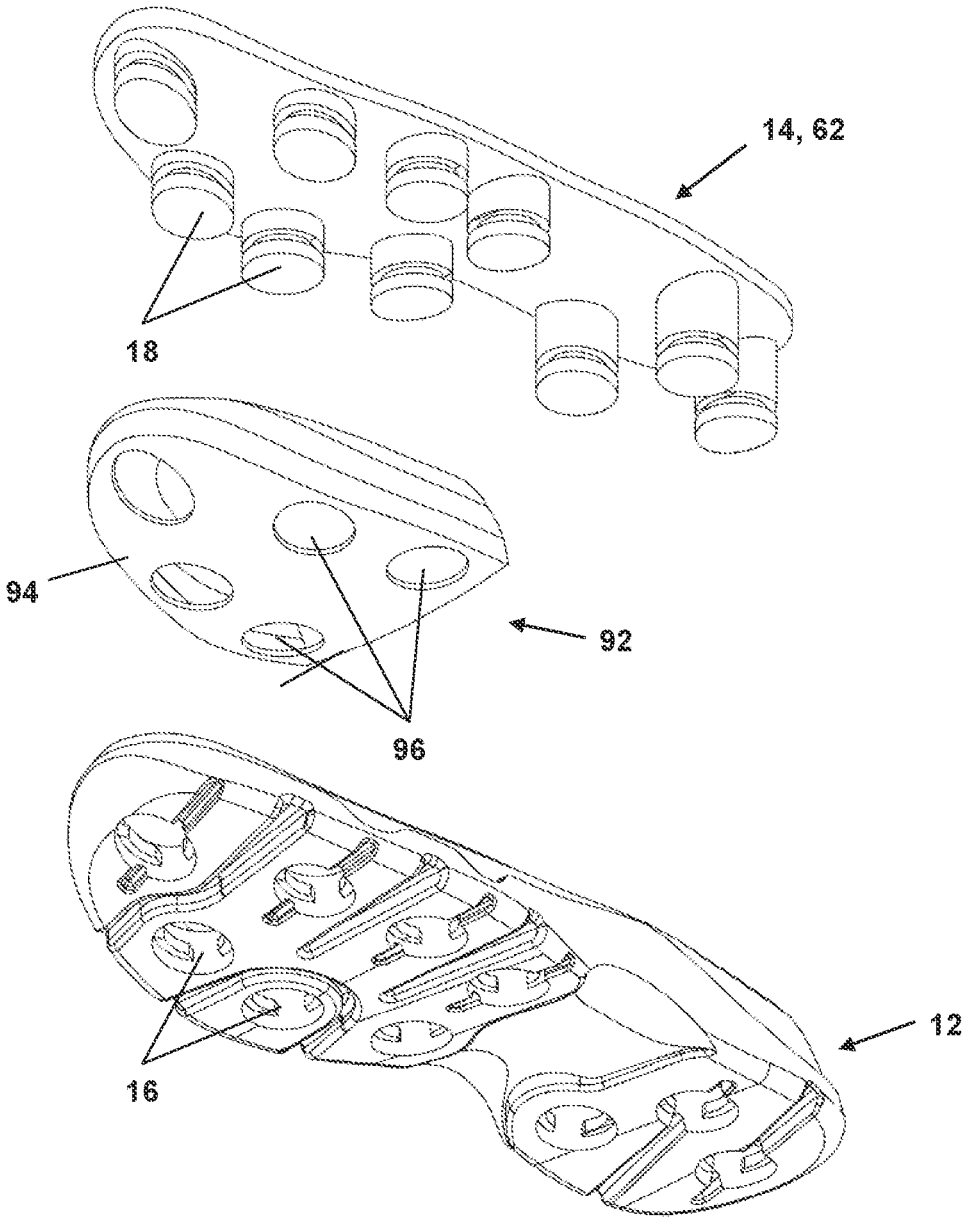

FIG. 8 shows another embodiment of a support element 72 in the form of a toe cap 92 which provides support to the toe box region of the shoe 10. Accordingly, the toe cap 92 is configured to conform around the outside of the toe box region of the upper arrangement 14 and comprises a base 94 which extends below the upper arrangement 14 so that, when in use, the base 94 is sandwiched between the upper arrangement 14 and the sole 12.

The base 94 comprises apertures 96 that are arranged to align with the male elements 18 provided on the upper arrangement 14, such that the male elements 18 protrude through the apertures 96 of the toe cap 92 when the base 94 of the toe cap 92 is arranged between the upper arrangement 14 and the sole 12, for engagement with the female elements 16 of the sole 12.

It should be appreciated that the toe cap 92 may alternatively be configured to fit inside the toe box region of the upper arrangement 14 shown in FIG. 5. In such examples, the toe cap 92 may be secured in place by sandwiching the base 94 of the toe cap 92 between the insole 62 and the base 66 of the upper 60 so that the male elements 18 provided on the insole 62 protrude through the apertures 96 toe cap 92 and into the respective female elements 16 provided in the sole 12.

The toe cap 92 is preferably made from a material that suitable for providing protection to the toes of the wearer when in use. Any suitable material may be used, such as for example a plastic or rubber material, and may be made by any suitable method such as moulding, 3D printing, or forming from a cut or stamped sheet of material. The base 94 may be made from a different material to the rest of the toe cap 92 so as to maintain a flexible and smooth profile on the footbed.

Figure 9:
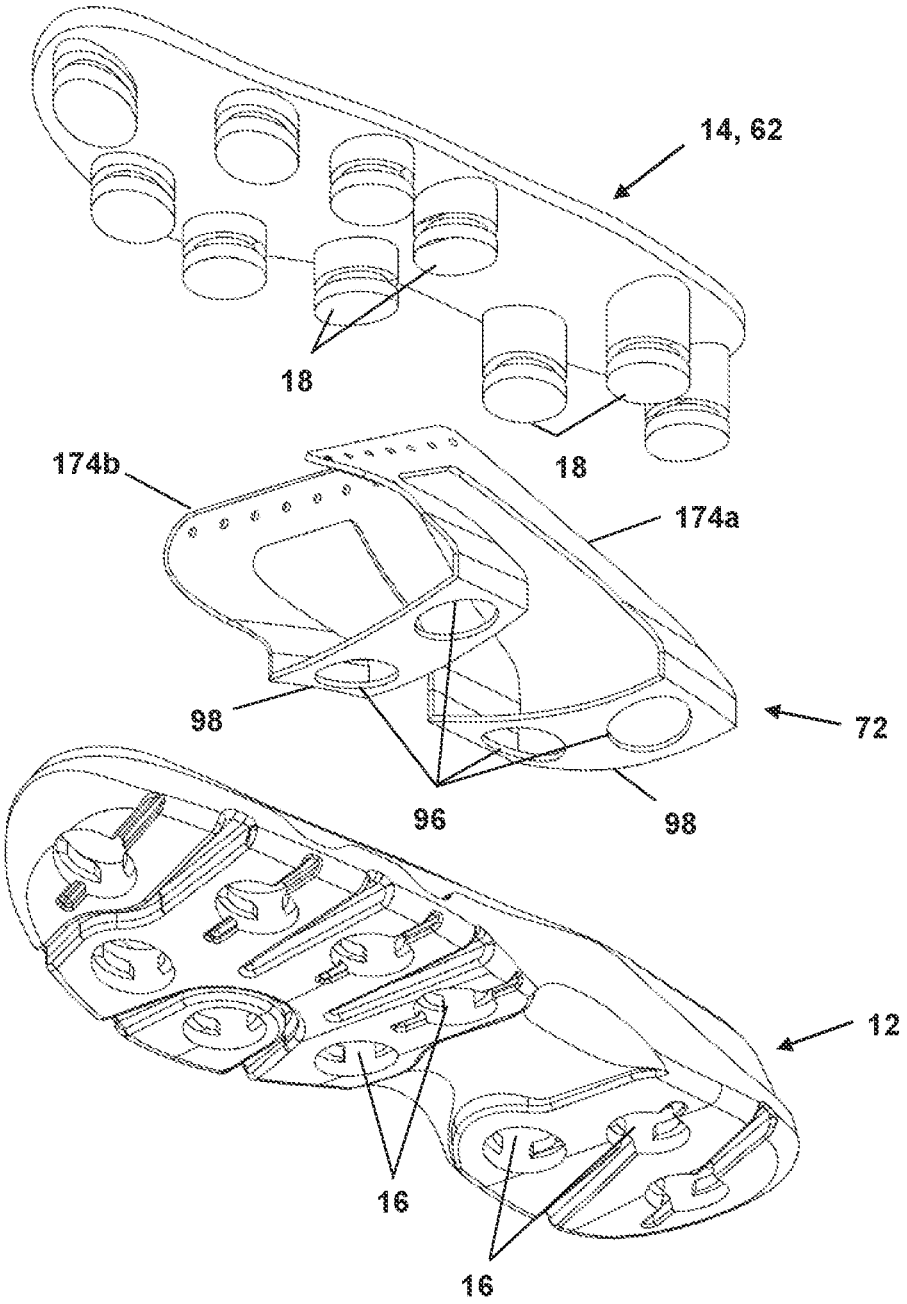

FIG. 9 shows an alternative embodiment of the previously described side support elements 74*a*, 74*b* shown in FIGS. 6*a* to 6*f*. In this embodiment, the left and right-side support elements 174*a*, 174*b* are coupled via a bridging region 98 which acts in much the same way as the base 94 of the toe cap 92 described above. That is to say, the side support elements 174*a*, 174*b* are secured in place by the sandwiching of the bridging region 98 between the upper arrangement 14 and the sole 12. Accordingly, the bridging region 98 comprises apertures 96 configured to align with the male elements 18 so that, in assembling the shoe 10, the male elements 18 can pass through the apertures 96 in the bridging region 98 to engage with the female elements 16 in the sole 12.

Figure 10:
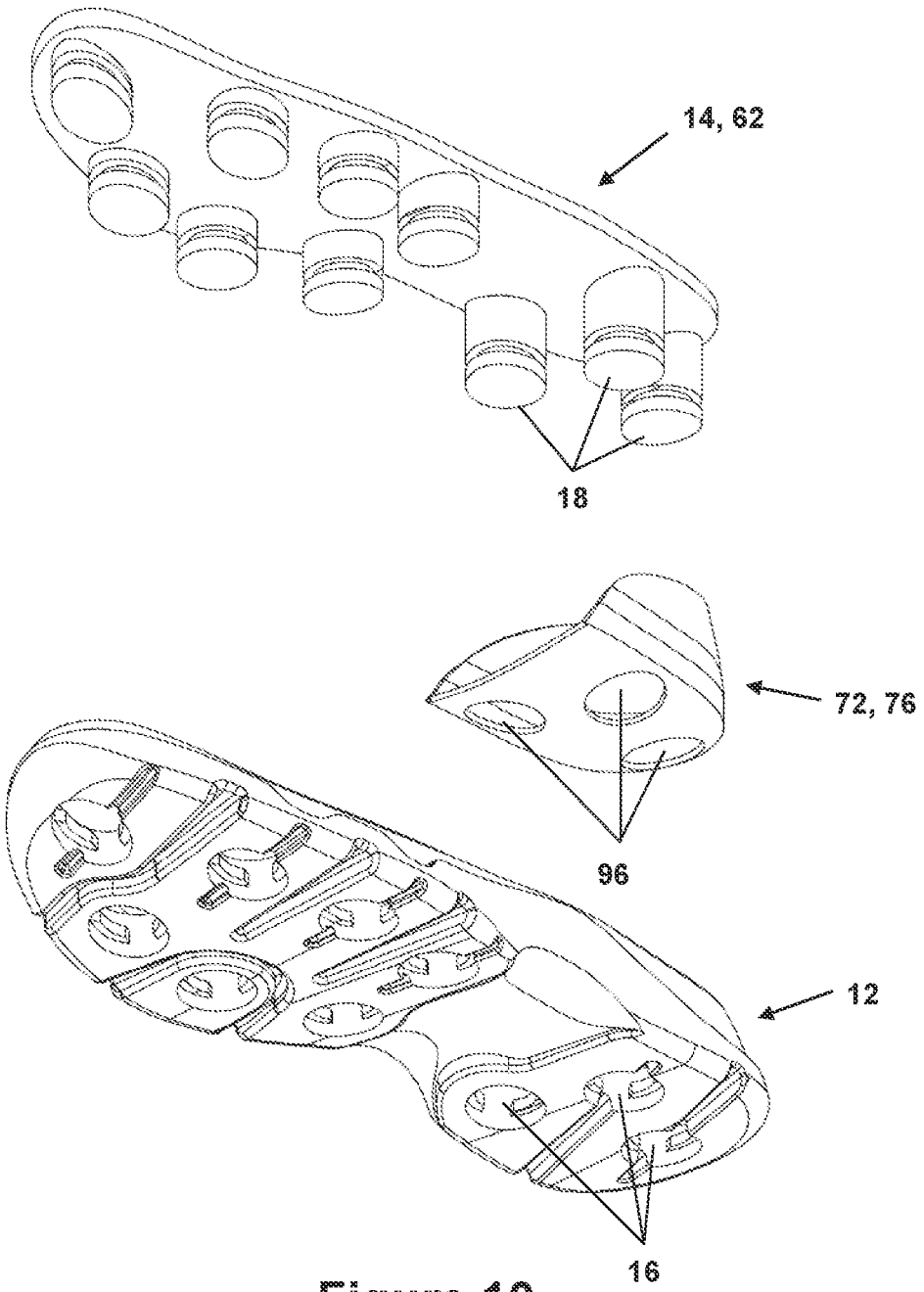

As shown in FIG. 10, this same principle of sandwiching a support element 72 between the upper arrangement 14 and the sole 12 can be applied to the rear heel support element 76, or to any other support elements 72 that may be required.

Although in the embodiments described the locking protrusion is an integral part of the female element, such that it is integrally formed with the peripheral surface, this need not necessarily be the case. For example, the protrusion could be formed as a separate locking element. In this case, the male or female element may include a recess for accommodating a first part of the separate locking element. A second part of the locking element may then be accommodated in the locking recess provided on the other of the male or female elements.

Other variations and adaptations are possible. For example, the male and female elements may be provided in any suitable size, shape or number, and may be arranged in any suitable locations on the shoe. Any suitable materials may be used for the components.

The upper arrangement may take any suitable form. In particular, embodiments are envisaged in which the upper does not completely encase the foot: for example, the upper may only partially encase the foot, or may comprise only straps or other features to secure the upper arrangement to the foot.

Other alterations will be apparent to the skilled person without falling outside the scope of the appended claims.

The invention claimed is:

1. A shoe comprising:

a sole comprising a female element;

an upper arrangement comprising:

a shoe upper having a base, a male element configured to be received in the female element upon insertion in an insertion direction, and an insole comprising an element-supporting surface and suitable for inserting into the shoe upper, wherein the male element comprises a body extending away from the element-supporting surface in the insertion direction; and a support structure configured to be sandwiched between the sole and insole when the shoe is assembled;

wherein the base is configured to accommodate the male element to allow insertion of the male element into the female element so that the base of the shoe upper is sandwiched between the sole and the insole when the shoe is assembled;

wherein the male element and the female element comprise complementary locking features comprising:

a first locking feature being provided on a peripheral surface of one of the male element or the female element and comprising a locking protrusion that protrudes in a direction transverse to the insertion direction, and a second locking feature being provided on a peripheral surface of the other of the male element or the female element and comprising a locking recess, wherein the locking protrusion is configured to engage with the locking recess as the male element is inserted into the female element, thereby locking the sole to the upper arrangement, wherein the female element comprises an opening in the sole for receiving the male element, and wherein the sole comprises a base surface that faces away from the upper arrangement when the shoe is assembled, and the opening is a hole extending through the sole to open onto the base surface.

2. The shoe of claim 1, wherein the body comprises a free end opposite the element-supporting surface and an outer peripheral surface that extends between the element-supporting surface and the free end.

3. The shoe of claim 2, wherein the complementary locking feature on the male element is provided on the outer peripheral surface.

4. The shoe of claim 1, wherein the opening defines an inner peripheral surface.

5. The shoe of claim 4, wherein the complementary locking feature on the female element is provided on the inner peripheral surface.

6. The shoe of claim 1, wherein the complementary locking feature on the female element is the first locking feature and the complementary locking feature on the male element is the second locking feature.

7. The shoe of claim 1, wherein the locking recess comprises a groove.

8. The shoe of claim 1, wherein the locking recess defines an opening for receiving the locking protrusion into the locking recess in an engagement direction, the engagement direction being transverse to the insertion direction.

9. The shoe of claim 1, wherein the locking protrusion protrudes from the peripheral surface to define a protrusion end offset from the peripheral surface, and the locking protrusion comprises a tapered end region extending between the protrusion end and the peripheral surface to meet the peripheral surface at an acute angle.

10. The shoe of claim 1, wherein the locking protrusion defines a first locking protrusion of a set of locking protrusions, wherein the set of locking protrusions are arranged to engage with the locking recess.

11. The shoe of claim 2, wherein the male element and the female element are configured such that the free end of the male element is substantially flush with the base surface to form a tread surface when the shoe is assembled for use.

12. The shoe of claim 1, wherein the base comprises an aperture through which the male element extends when the insole is inserted into the shoe upper.

13. The shoe of claim 1, wherein the sole comprises a plurality of female elements and the upper arrangement comprises a corresponding male element for each female element.

14. The shoe of claim 1, wherein the male element is made from substantially the same material as the sole.

15. The shoe of claim 1, wherein the male element and/or the sole are made of an elastically deformable material.

16. The shoe of claim 1, wherein the locking protrusion of the first locking feature is formed integrally on the peripheral surface of the male element or the female element.

17. A method of assembling the shoe of claim 1, the method comprising:

inserting the male element into the female element in an insertion direction; and engaging the first locking feature with the second locking feature as the male element is inserted into the female element, thereby locking the sole to the upper arrangement.

18. The shoe of claim 1, wherein the support structure comprises:

a first support element configured to receive a shoelace;

a second support element configured to receive the shoelace; and a bridge extending between the first support element and the second support element, the bridge comprising an aperture configured to align with the male element to allow the male element to pass through the aperture to sandwich the support structure between the sole and the insole when the shoe is assembled.

19. The shoe of claim 7, wherein the groove is defined by opposing horizontal side surfaces.

20. A shoe comprising:

a sole comprising a female element;

an upper comprising a corresponding male element configured to be received in the female element upon insertion in an insertion direction; and a support structure configured to be sandwiched between the sole and the upper, the support structure comprising:

a first support element configured to receive a shoelace;

a second support element configured to receive the shoelace; and a bridge extending between the first support element and the second support element, the bridge comprising an aperture configured to align with the male element to allow the male element to pass through the aperture to sandwich the support structure between the sole and the upper when the shoe is assembled;

wherein the male element and the female element comprise complementary locking features including:

a first locking feature on a peripheral surface of one of the male element or the female element and comprising a locking protrusion that protrudes in a direction transverse to the insertion direction, and a second locking feature on a peripheral surface of the other of the male element or the female element and comprising a locking recess, the locking protrusion configured to engage with the locking recess as the male element is inserted into the female element, thereby locking the sole to the upper.

* * * * *